US005138996A

United States Patent [19]

Fiorenza, II

[11] Patent Number: 5,138,996

[45] Date of Patent: Aug. 18, 1992

[54] MICROPROCESSOR-BASED ENGINE SPEED LIMITER

[75] Inventor: John A. Fiorenza, II, Slinger, Wis.

[73] Assignee: Briggs & Stratton Corporation, Wauwatosa, Wis.

[21] Appl. No.: 755,326

[22] Filed: Sep. 5, 1991

[51] Int. Cl.[5] ..... F02P 5/15; F02P 11/00

[52] U.S. Cl. ..... 123/335; 123/198 DC

[58] Field of Search ..... 123/334, 335, 352, 418, 123/630, 198 DC

[56] References Cited

U.S. PATENT DOCUMENTS

| | | | |
|---|---|---|---|
| 3,563,219 | 7/1969 | Mieras | 123/335 |
| 3,581,720 | 6/1971 | Hemphill et al. | 123/335 |
| 3,601,103 | 8/1971 | Swiden | 123/335 |
| 3,767,972 | 10/1973 | Noddings et al. | 361/240 |
| 3,916,865 | 11/1975 | Kiencke et al. | 123/198 DB |
| 4,034,732 | 7/1977 | Van Burkleo | 123/198 DC |
| 4,058,094 | 11/1977 | Moore | 123/356 |
| 4,074,665 | 2/1978 | Patis | 123/335 |
| 4,237,997 | 12/1980 | Swanson | 180/272 |
| 4,307,690 | 12/1981 | Rau et al. | 123/353 |
| 4,336,778 | 6/1982 | Howard | 123/334 |
| 4,491,105 | 1/1985 | Johansson | 123/335 |
| 4,570,595 | 2/1986 | Andreasson | 123/335 X |
| 4,625,689 | 12/1986 | Komurasaki | 123/335 |
| 4,648,366 | 3/1987 | Thornton-Trump | 123/335 |
| 4,664,080 | 5/1987 | Minks | 123/335 |
| 4,733,644 | 3/1988 | Staerzl | 123/352 |
| 4,875,448 | 10/1989 | Dykstra | 123/352 |
| 4,883,033 | 11/1989 | Hosoe et al. | 123/335 |
| 5,009,208 | 4/1991 | Fiorenza, II | 123/335 |

FOREIGN PATENT DOCUMENTS

| | | | |
|---|---|---|---|
| 59-25082A | 2/1984 | Japan | 123/335 |
| 59-168274A | 9/1984 | Japan | 123/335 |

OTHER PUBLICATIONS

Motorola Semiconductor Technical Data on MC68HC05P4 Microprocessor Published in Jan. 1990.

Microprocessor, Microcontroller and Peripheral Data Catalog, Published by Motorola in Jan. 1988.

HC05-MC68HC705P9 Technical Data, published by Motorola in Jan. 1991.

*Primary Examiner*—Willis R. Wolfe

*Attorney, Agent, or Firm*—Andrus, Sceales, Starke & Sawall

[57] ABSTRACT

The microprocessor-based speed limiter compares a speed value functionally related to the actual speed of the engine with a stored reference value and generates a limit signal to ground the ignition pulses if the speed value is greater than or equal to the reference value. The ignition pulses are preferably grounded for a preselected number of engine revolutions, after which another comparison is made to determine whether the actual engine speed is below the maximum limit speed. Both the stored reference value and the preselected number of engine revolutions may be changed.

19 Claims, 2 Drawing Sheets

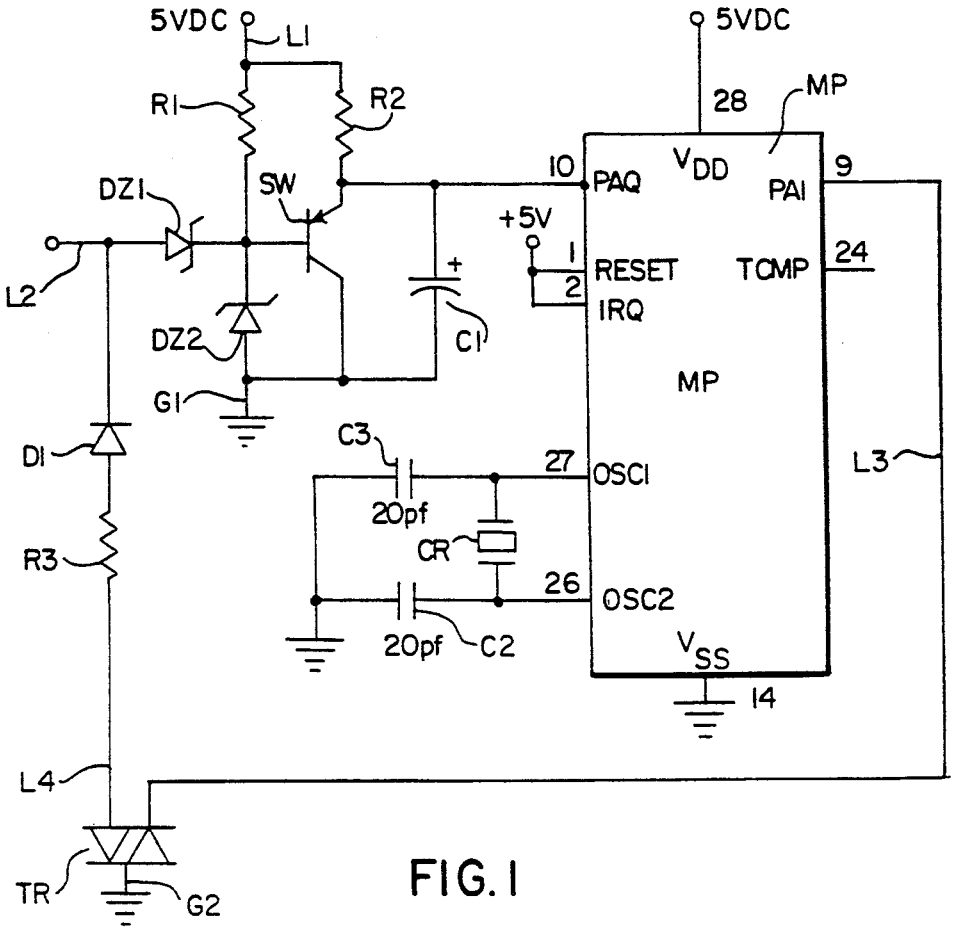
FIG. 1
FIG. 2A
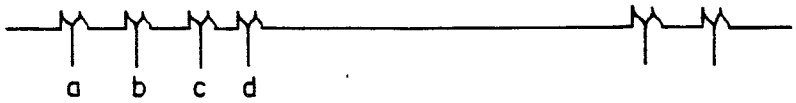
FIG. 2B
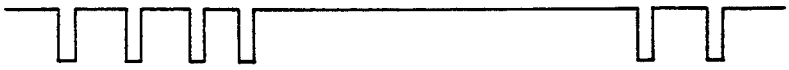
FIG. 2C
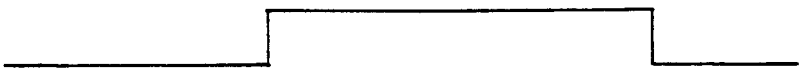

MICROPROCESSOR-BASED ENGINE SPEED LIMITER

BACKGROUND OF THE INVENTION

This invention relates to speed limiters for internal combustion engines, and more particularly to speed limiters for small internal combustion engines of the type used to power lawn mowers, snow blowers, generators and the like.

It is often desirable to limit the speed of an engine to a predetermined maximum or limit speed. Many types of electronic speed limiters are known. One type operates off the engine's alternator. Since the alternator typically provides a voltage proportional to the engine speed, controlling the maximum voltage that may be reached by the alternator then controls the engine's maximum speed.

Another type of engine speed limiter compares a signal functionally related to the engine speed with a reference signal functionally related to a maximum limit speed. If the result of the comparison indicates that the actual engine speed is higher than the maximum limit speed, ignition pulses from the primary winding are grounded so that the engine coasts down to a lower speed. Although the ignition pulses are being grounded, fuel is still being pumped into the combustion chamber. A great deal of fuel collects in the combustion chamber and is exhausted through the exhaust system. The exhausted fuel may be ignited by the hot muffler, causing backfire. This backfire results in an undesirable loud noise and may harm the engine components.

Other types of electronic speed limiters generate a reference speed signal that is not easily changed. For example, U.S. Pat. No. 5,009,208 issued Apr. 23, 1991 to Fiorenza, II and assigned to Briggs & Stratton Corporation discloses an electronic speed limiter using discrete frequency dividers and other components to compute the reference signal from a one MHz input signal. Although Fiorenza '208 discloses a very accurate engine speed limiter which only grounds a preselected number of ignition pulses, neither the reference speed signal nor the preselected number of grounded ignition pulses may be changed.

U.S. Pat. No. 3,767,972 issued Oct. 23, 1973 to Noddings et al discloses an analog system in which a reference voltage may be stored in an electrical memory circuit, and may be changed by the operator. However, the Noddings et al system is very complicated and expensive since it requires many components parts. It is also very difficult to accurately adjust the reference voltage due to the nature of the analog devices being used.

SUMMARY OF THE INVENTION

The electronic speed limiter according to the present invention uses a minimum number of components parts, is very accurate, and has readily changeable parameters.

In a preferred embodiment, the speed limiter includes a computing means such as a microprocessor for computing a speed value functionally related to the actual engine speed and to the time between successive ignition pulses, and a storing means in a digital memory unit within the microprocessor for storing a reference value that is functionally related to a maximum limit speed.

A comparison means within the microprocessor then compares the speed value with the reference value and generates a limit signal if the speed value is about equal to or greater than the reference value. The limit signal activates a switch means to prevent the ignition pulses from firing a fuel igniter such as a spark plug. The ignition pulses may be grounded or shorted to prevent the firing of the fuel igniter.

In the preferred embodiment, only a preselected number of ignition pulses is grounded or shorted, at which time the comparison means determines whether the actual engine speed is now below the maximum limit speed.

The stored reference value and the stored preselected number may be easily changed if stored in an ultraviolet or electrically Erasable Programmable Read Only Memory (EPROM) unit. This feature enables the same speed limiter to be used in a wide variety of applications.

It is a feature and advantage of the present invention to minimize the number of components parts in an electronic speed limiter.

It is another feature and advantage of the present invention to provide an engine speed limiter whose major parameters may be readily changed.

It is yet another feature and advantage of the present invention to reduce backfire, fuel consumption and pollution in a small internal combustion engine.

These and other features of the present invention will be apparent to those skilled in the art from the following detailed description of the preferred embodiment and the attached drawings, in which:

BRIEF DESCRIPTION OF THE DRAWINGS

FIG. 1 is a schematic diagram depicting the preferred embodiment of the present invention.

FIGS. 2A–2C are timing diagrams relating to the preferred embodiment depicted in FIG. 1.

FIG. 2A depicts the primary winding voltage.

FIG. 2B depicts the input voltage at pin 10 of the microprocessor.

FIG. 2C depicts the output voltage at pin 9 of the microprocessor.

DETAILED DESCRIPTION OF THE PREFERRED EMBODIMENT

Figure 3:
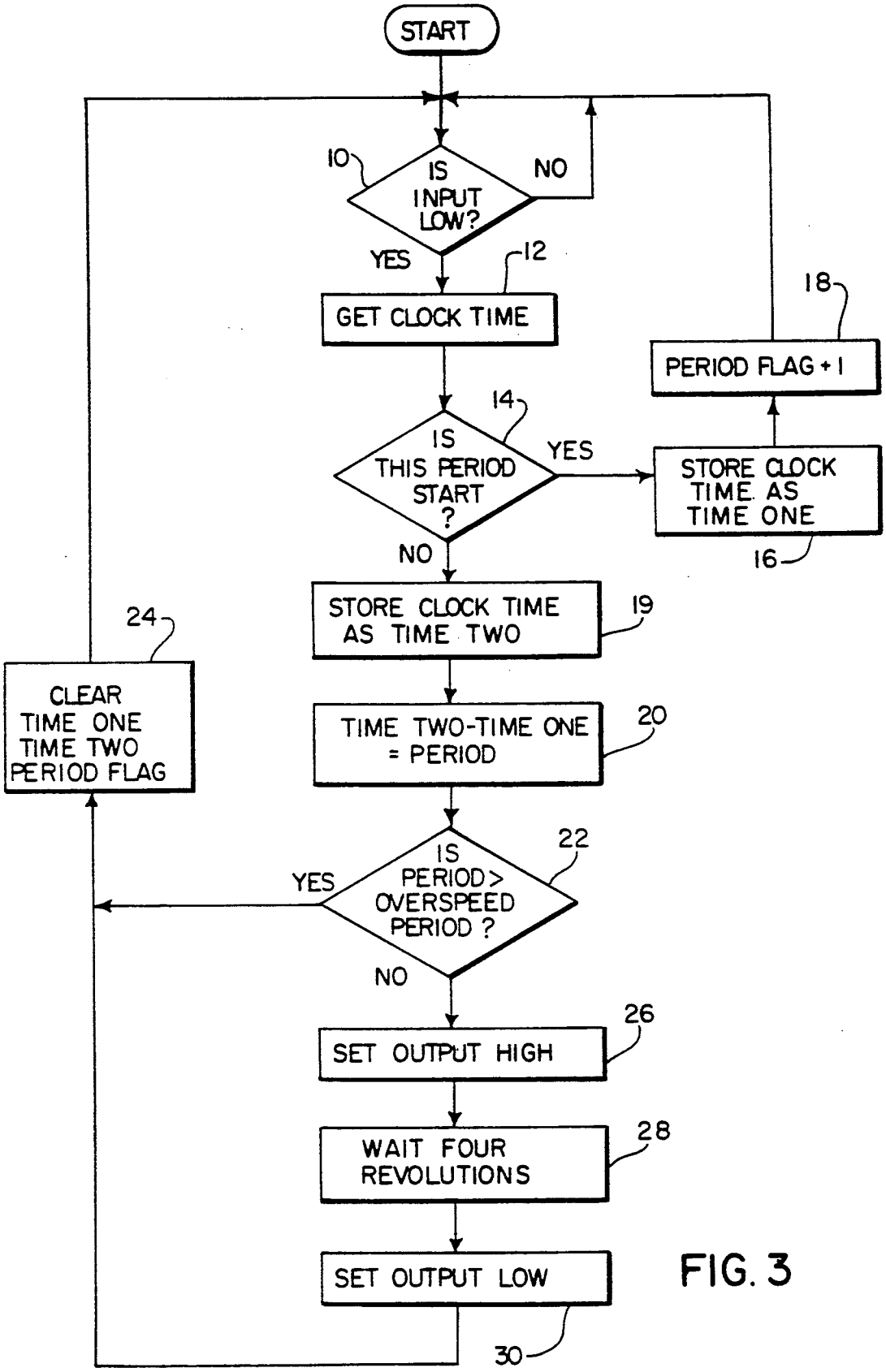
FIG. 3 is a flow chart depicting the operation of the microprocessor according to the present invention.

FIG. 1 is a schematic diagram of a preferred embodiment of the present invention. The schematic includes an input circuit consisting of resistors R1 and R2, zener diodes DZ1 and DZ2, a PNP transistor switch SW, and a capacitor C1. The input circuit is connected to a five VDC power source via line L1. The input circuit keeps the input voltage at pin 10 of microprocessor MP at a +5 volts until an ignition pulse is received by the input circuit on line L2 from the ignition primary winding. Other negative-going or even positive-going voltage sources may be used in place of the ignition pulses from the primary winding, as long as those signals are generated every time the ignition is firing a designated spark plug, and those signals are of the type that may be sensed by the microprocessor.

Diode DZ1 prevents false signals from gating on switch SW. Diode DZ1 is a 9 volt zener diode that must receive at least a −4.7 volt signal before it outputs any signal to switch SW. Diode DZ2 is a 9-volt zener diode which protects switch SW from very large negative voltages when the ignition pulse goes negative. At that time, the current is drawn from ground G1 through diode DZ2 and through the primary winding instead of pulling the current through resistor Rl. Diode DZ2 prevents the emitter to base or collector to base voltage of transistor switch SW from exceeding 5.0 volts.

Capacitor C1 is a filter capacitor which prevents false signals otherwise indicative of sensed negative-going ignition pulses from being present at pin 10 if the primary winding begins ringing.

Resistor R1 is a biasing resistor which keeps switch SW off to keep pin 10 of the microprocessor at a +5 volts unless a negative-going ignition pulse is input on line L2. In that event, switch SW is turned on to bring the voltage at pin 10 low to about 0.2 volts. As discussed below, the falling edge of the 5 volt signal at pin 10 is sensed by the microprocessor as an indication that the ignition system has fired the spark plug, causing the microprocessor to store the time of that event.

Capacitors C2, C3 and crystal CR together comprise an oscillator for the free-running clock in microprocessor MP. Crystal CR is preferably a 4 MHz crystal whose frequency is divided by two in the microprocessor, so that the microprocessor clock runs at 2 MHz. Capacitors C2 and C3, in combination with the voltage signals applied by the microprocessor on pins 26 and 27, comprise a resonant circuit that causes the crystal to oscillate at the resonant frequency.

Microprocessor MP is powered by a +5 VDC voltage source which provides a +5 volt signal at pin 28 of microprocessor MP. One suitable microprocessor is a MC68HC05P4 8-bit microcontroller unit available from Motorola, Inc. Of course, many other types of microprocessors could be used.

The reset input at pin 1 of microprocessor MP and the interrupt request at pin 2 of the microprocessor are disabled by tying them high to the +5 volt source. Pin 24 is a timer compare pin that should also be tied high since it is not used. The remaining pins of the microprocessor except pin 9 are unused and should be grounded.

The limit signal discussed herein is output at pin 9 of microprocessor MP. The limit signal gates on triac TR via line L3 when the actual engine speed is about equal to or greater than the maximum limit speed, as discussed below. The gating on of triac TR grounds the ignition pulses via line L4, diode D1, resistor R3 and ground G2. Resistor R3 limits current to triac TR to a value below its maximum rating. Diode Dl prevents false triggering of triac TR when the ignition pulse becomes positive.

FIGS. 2A through 2C are timing diagrams depicting the most important signals present in the circuit depicted in FIG. 1. FIG. 2A depicts the successive ignition pulses input at line L2 in FIG. 1. The time between successive ignition pulses, or period, is used to determine whether the actual engine speed is greater than the maximum limit speed stored as a reference value in the microprocessor.

FIG. 2B depicts the input at pin 10 of the microprocessor. The input signal goes low when a negative-going ignition pulse is received, and remains low until the ignition pulse ends.

FIG. 2C depicts the output at pin 9 of the microprocessor. The output goes high—corresponding to the generation of a limit signal—when the time between successive ignition pulses is less than a reference value.

Comparing FIGS. 2A through 2C, the time between successive ignition pulses a and b of FIG. 2A is greater than the reference value, thereby keeping the output at pin 9 in its low state. However, the time between successive pulses c and d in FIG. 2A is less than the stored reference value, causing a 5 volt limit signal as depicted in FIG. 2C to be generated at pin 9 of the microprocessor.

The limit signal is generated for a preselected number of engine revolutions, with the preselected number preferably being in the range of between about 2 to 10 engine revolutions for a one-cylinder engine. The preselected number is stored within the microprocessor. Although a trial and error method is used to determine the preselected number, several factors are considered in choosing the appropriate number. These factors include whether the engine is backfiring due to the release of an excessive amount of fuel through the exhaust system, and whether the engine is sufficiently slowing so that the actual engine speed becomes less than the maximum limit speed. The engine load conditions and the desired engine speed are also factors to be considered. For a one-cylinder internal combustion engine, the grounding of 4–5 successive ignition pulses has been found to be particularly desirable.

After the preselected number of engine revolutions has passed, the limit signal is terminated and the time between successive engine pulses is again determined, as described below.

Both the reference value and the preselected number are stored in the microprocessor. If a Motorola MC68HC05P4 or similar device is used for the microprocessor, the reference value and the preselected number are etched into the chip during manufacturing. When other microprocessors are used, the reference value and the preselected number may be stored in an Erasable Programmable Read Only Memory (EPROM) or in an Electrically - Erasable Programmable Read Only Memory (EEPROM). One suitable microprocessor with an EPROM unit is a Motorola MC68HC705P9. A suitable microprocessor with an EEPROM unit is a Motorola MC68HC805B6. If these types of microprocessors are used, the stored reference value and the preselected number are easily erased and changed as is well known in the art.

FIG. 3 is a flow chart that more particularly illustrates the internal operation of microprocessor MP.

In FIG. 3, the microprocessor first determines at step 10 whether the input at pin 10 is low. If the input is not low, then the system returns to Start to again check whether the input is low. If the input at pin 10 is low, the current time of the free-running internal clock is marked at step 12 since a negativegoing ignition pulse has been sensed at pin 10.

A determination is then made at step 14 as to whether the marked clocked time is the beginning of a new period. If the marked clock time is the beginning of a new period, then that clock time is stored as Time One at step 16, the period flag is incremented by one at step 18, and the system returns to Start to obtain a clock time corresponding to the second or next ignition pulse so that the time between successive ignition pulses may be determined.

If the marked clock time does not begin a new period, this indicates that the marked time corresponds to the second ignition pulse, and that a first time has already been stored at step 16 in a memory location as Time One. Thus, the marked clock time is stored as Time Two at step 19.

The period is then determined at step 20 by subtracting the first time or Time One from the second time or Time Two. The resulting period is then compared at step 22 with a reference Value, which is stored as an overspeed period in another memory location within the microprocessor. The digital memory unit may also be outside of the microprocessor. In any case, if the period determined at step 20 is greater than the reference, overspeed period, this indicates that the actual engine speed is less than the maximum limit speed corresponding to the overspeed period. Thus, no action needs to be taken to limit the engine speed. The memory locations corresponding to Time One, Time Two and the period flag are then cleared at step 24 and the system returns to Start.

If the comparison at step 22 indicates that the period between ignition pulses is less than or about equal to the stored reference value, the output at pin 9 of the microprocessor is set high at step 26, thereby generating a limit signal which gates on triac TR as discussed above in connection with FIG. 1. The ignition pulses are then grounded via line L4 and ground G2 for a preselected number of engine revolutions. In FIG. 3, it is assumed that the preselected number is 4.

The system then waits for the four revolutions at step 28 during which time the limit signal is being generated. After four revolutions, the limit signal is terminated by setting the output at pin 9 low at step 30. The memory locations for Time One, Time Two and the period flag are then cleared at step 24 and the system returns to Start to again check whether the input at pin 10 is low.

While particular embodiments of the present invention have been shown and described, alternate embodiments will be apparent to those skilled in the art and are within the intended scope of the present invention. Thus, the invention is limited only by the following claims.

I claim:

1. A speed limiter for an internal combustion engine that has a fuel igniter and that generates successive pulses functionally related to the actual speed of said engine, comprising:
   computing means for computing a speed value functionally related to the actual engine speed and to the time between said successive pulses;
   storing means for storing a reference value functionally related to a maximum limit speed;
   comparison means for comparing said speed value with said reference value, and for generating a limit signal if the result of the comparison indicates that the actual engine speed is about equal to or greater than said maximum limit speed; and
   switch means for activating in response to said limit signal to prevent the firing of said fuel igniter.

2. The speed limiter of claim 1, wherein said computing means includes a microprocessor.

3. The speed limiter of claim 1, wherein said computing means includes a timer.

4. The speed limiter of claim 1, wherein said storing means includes a digital memory unit.

5. The speed limiter of claim 1, wherein said comparison means includes a microprocessor.

6. The speed limiter of claim 1, wherein said switch means includes a triac.

7. The speed limiter of claim 1, further comprising:
   means for grounding said pulses when said switch means is activated.

8. The speed limiter of claim 1, further comprising:
   second storing means for storing said speed value; and
   means for clearing said second storing means after said comparison means has compared said stored speed value with said reference value.

9. The speed limiter of claim 1, further comprising:
   means for changing said reference value.

10. A speed limiter for an internal combustion engine that has a fuel igniter and that generates successive pulses functionally related to the actual speed of said engine, comprising:
   computing means for computing a speed value functionally related to the actual engine speed and to the time between said successive pulses;
   storing means for storing a reference value functionally related to a maximum limit speed; and
   comparison means for comparing said speed value with said reference value, and for generating a limit signal for a preselected number of engine revolutions if the result of said comparison indicates that the actual engine speed is about equal to or greater than said maximum limit speed.

11. The speed limiter of claim 10, wherein said computing means includes a microprocessor.

12. The speed limiter of claim 10, wherein said storing means includes a digital memory unit.

13. The speed limiter of claim 10, wherein said comparison means includes a microprocessor.

14. The speed limiter of claim 10, further comprising:
   means for changing said preselected member.

15. The speed limiter of claim 10, further comprising:
   means for changing said reference value.

16. The speed limiter of claim 10, further comprising:
   second storing means for storing said speed value; and
   means for clearing said second storing means after said comparison means has compared said stored speed value with said reference value.

17. The speed limiter of claim 10, further comprising:
   switch means for activating in response to said limit signal to prevent the firing of said fuel igniter.

18. The speed limiter of claim 17, wherein said switch means includes a triac.

19. The speed limiter of claim 17, further comprising:
   means for grounding said pulses when said switch means is activated.

* * * * *